US005947478A

United States Patent [19]

Kwan et al.

[11] Patent Number: 5,947,478

[45] Date of Patent: Sep. 7, 1999

[54] TOY ELECTRONIC GAME WITH FLEXIBLE INTERACTIVE PLAY SECTION

[76] Inventors: David Chu Ki Kwan; Ng Wing Kwong, both of Block A & B, 3rd Floor, CDW Building, 382-392 Castle Peak Road, Tsuen Wan, N.T., The Hong Kong Special Administrative Region of the People's Republic of China

[21] Appl. No.: 08/861,470

[22] Filed: May 21, 1997

[51] Int. Cl.[6] ..... A63F 9/24

[52] U.S. Cl. ..... 273/460

[58] Field of Search ..... 273/447, 440, 273/459, 460, 139, 138.2

[56] References Cited

U.S. PATENT DOCUMENTS

| | | |
|---|---|---|
| 3,911,234 | 10/1975 | Kotaka . |
| 4,028,509 | 6/1977 | Zurcher . |
| 4,105,899 | 8/1978 | Velosa . |
| 4,247,109 | 1/1981 | Horan et al. . |
| 4,364,619 | 12/1982 | Inayat-Kahn . |
| 4,589,659 | 5/1986 | Yokoi et al. . |
| 4,700,369 | 10/1987 | Siegal et al. . |
| 4,820,236 | 4/1989 | Berliner et al. . |
| 4,931,782 | 6/1990 | Jackson . |
| 5,001,308 | 3/1991 | Mori . |

OTHER PUBLICATIONS

Advertisement of Summagraphics Corporation for the Summaflex digitizer 1995 copyright.

*Primary Examiner*—Jessica J. Harrison
*Assistant Examiner*—John Paradiso
*Attorney, Agent, or Firm*—Brown Raysman Millstein Felder & Steiner LLP

[57] ABSTRACT

An electronic game is disclosed having an interactive play section of relatively large area which can quickly and easily be reconfigured to occupy a much smaller space. The interactive section does not require a rigid frame and is either flexible or includes flexible portions which enable it to be reconfigured, e.g., by folding, overlaying or rolling. The electronic game also includes an electronics section which may be rigid or include rigid parts but which is of a size such that the overall size of the game when the interactive section is reconfigured is effectively determined by the reconfigured interactive section. The particular game may be any suitable game which requires interactivity between the game and the player, for example, an electronic game which tests a player's reaction time and coordination by providing prompts to the player and scoring the responses. The interactive section provides the prompts, or receives the responses to the prompts, or both, and the electronics section controls issuing of the prompts and scores the responses.

41 Claims, 8 Drawing Sheets

TOY ELECTRONIC GAME WITH FLEXIBLE INTERACTIVE PLAY SECTION

BACKGROUND OF THE INVENTION

The invention disclosed herein relates to an electronic game having an interactive play section of relatively large size which in use must be supported extending over a relatively large area and which can be folded or rolled up into a compact configuration for storage and/or transporting.

Electronic games with a large interactive play section have heretofore been supported by rigid housings which in turn are supported by a stand or on an existing piece of furniture such as table, or on the floor. For example, electronic arcade games such as pinball machines and a game having similarities to the electronic toy game disclosed herein are supported by a rigid housing and a stand. These electronic games are not intended to simply be broken down or reconfigured by a consumer for storage, and obviously can not be folded or rolled up into a compact configuration for storage and/or transporting.

U.S. Pat. No. 4,247,109 discloses an electronic pinball machine including flexible sheets on which electrical circuitry is supported and a rigid housing in which the flexible sheets are permanently mounted and supported. This patent states that the pinball machine is adapted primarily for hand held operation, but that the invention therein has utility for game constructions which are floor supported. While the hand held construction would be relatively small and therefore would not seem to need to be converted into a compact configuration for storage or shipping, the floor stand construction may be relatively large so that easy conversion to a compact configuration would be desirable. However, like the hand held construction, the floor stand construction would include a rigid housing which would preclude folding or rolling the game into a compact configuration.

U.S. Pat. No. 4,700,369 discloses an input and display device for counting events (e.g., laps) in athletic activities which includes end sections incorporating electronic circuitry, touch pad switches, batteries or a display interconnected by a flexible section through which wires are run connecting components in the two end sections. The flexible section is not interactive and its size is determined by the spacing desired between the end sections for functional reasons described in the patent. Although the device may be rolled up, only the end sections are interactive which themselves call not be folded or rolled up.

Flexible circuits have been used in at least the following applications: touch screens and digitizers (U.S. Pat. Nos. 4,931,782 and 5,001,308, and SummaFlex digitizer available from CalComp Technology, Inc.); keyboards for calculators and watches (U.S. Pat. Nos. 3,911,234, 4,364,619 and 4,028,509); a switch activated by the weight of a person standing on a mat incorporating the switch (U.S. Pat. No. 4,105,899); and flexible printed circuit connectors (U.S. Pat. No. 4,589,659).

There is a need unfulfilled by the prior art of an interactive electronic game having an interactive play section of large area in its play configuration, which may be reconfigured to occupy a relatively small space having a much smaller area than that of the interactive play section when in its play configuration. The present invention provides such an electronic game.

OBJECTS AND SUMMARY OF THE INVENTION

It is an object of the invention disclosed herein to provide an electronic game with an interactive play section of large area which can be reconfigured quickly and easily, for example by folding or rolling, into a compact form for storage and/or transporting.

It is another object of the invention to provide an inexpensive electronic game with an interactive play section of large area for the home toy market.

The invention disclosed herein achieves the above and other objects by providing an electronic game having an interactive play section of relatively large area which can quickly and easily be reconfigured to occupy a space with a largest side having all area that is substantially less than half the area of the interactive section. Structure which enables the interactive section to be reconfigured may comprise hinges, flexible sheets, strips or tubing, narrow flexible or weakened regions, etc., which allow the interactive section to be folded, overlapped, rolled, etc. The interactive section need not be and preferably is not mounted in a rigid frame in order to play the game, and may be placed on any suitable support such as a table, desk or the floor.

For example, the interactive section may be about 0.5 m by 1 m, but the range of sizes encompassed by the invention is wide, for example from small hand held games which, for example, one may want to fold or roll into say pocket size, to large arcade games, for example from 0.5 m by 1 m up to 1 m by 2 m or even larger for a "Twister" type of game in which persons stretch between and contact active areas of the interactive section. The larger games may be played by more than one person at a time.

The electronic game also includes an electronics section which may be rigid or include rigid parts, or which may be disposed in a rigid housing, but which is of a size such that the overall size of the game when the interactive section is reconfigured is effectively determined by the reconfigured interactive section. For example, for a game with an interactive section of size 0.5 m by 1 m, the electronics section may be less than about 12 cm by 12 cm.

The particular game may be any suitable game which requires interactivity between the game and the player. According to the invention, the interactive section with which the player interacts may have a large area and yet be compactly reconfigured.

In the preferred embodiment, the electronic game is one which test a player's reaction time and coordination, in which the game provides prompts to the player which require responses, and in which the game scores the responses. The interactive section provides the prompts, or receives the responses to the prompts, or both, and the electronics section controls issuing of the prompts and scores the responses. The interactive section and the electronics may cooperate in other ways for other games.

For example, the interactive section may visually and/or audibly prompt a response which requires that the player place an object in close proximity to, or forcibly or in light contact with an active location of the interactive section. Objects which can be used to activate the active locations are one's finger, hand, foot, a mallet, etc. She electronics section controls activating the interactive section to provide the visual and/or audio prompt, registering the location of the response, and timing the response.

An interactive electronic game incorporating the invention comprises an interactive section and an electronics section, and provides prompts to a player and receives and scores or otherwise acknowledges the player's response. The interactive section includes prompting circuitry coupled to the electronics section and one or more prompters which provide the prompts, or receptor circuitry coupled to the electronics section and one or more receptors which receive the responses, or both, and a plurality of active locations which each include a prompter or part thereof, or a receptor or part thereof, or both. The interactive section has a playing configuration with a largest side having a first area and a non-playing configuration with a largest side having a second area which, as mentioned, is less than half of the first area, and the interactive section includes a flexible portion or portions (e.g., sheet or tubing material, flexible conductors, etc.) so as to be reconfigurable (e.g., overlayable foldable, or rollable) from the playing configuration to the non-playing configuration and in reverse from the non-playing configuration to the playing configuration.

The prompters and/or the receptors may comprise discrete devices or non-discrete (or distributed) devices with parts extending over the interactive section, and each active location of the interactive section includes a discrete prompter or part of a distributed prompter, or a discrete receptor, or part of a distributed receptor, or both.

In the preferred embodiments, the prompter or prompters comprise an indicator or indicators that provide visually perceptive prompts. The indicators may be discrete devices such as small or miniature bulbs or light emitting diodes or other devices which emit light, or display devices (e.g., non-discrete or (distributed devices) such as LCD, etc.).

The receptors may comprise discrete devices such as touch, contact or pressure switches, or non-discrete or (distributed devices) such as position detection devices like a digitizer, all of which may be incorporated in an interactive section that may be reconfigured as by folding it or rolling it up. In specific preferred embodiments, each discrete receptor comprises a force responsive device (e.g., an electrical switch) which is senses the presence of the object when forced against the respective active location, and each prompter comprises a discrete indicator device (e.g., a lamp).

In the preferred embodiments, the interactive section includes both the prompting circuitry and the prompter(s), and the receptor circuitry and the receptor(s), and each active location includes both a prompter or part thereof and a receptor or part thereof.

In the preferred embodiment, the interactive section includes a plurality of discrete indicator devices, a plurality of discrete electrical switches, and a plurality of spaced active locations which each include an indicator device and a switch. The indicator devices and the switches are coupled to the electronics section by flexible conductors, and interconnected by flexible sheets. The interactive section comprises at least first and second flexible sheets between which the conductors extend. The conductors coupling respective switches to the electronic section comprise first conductors each coupling a first side of a respective switch to the electronics section and a second conductor or conductors which couple a second side of each switch to the electronics section. A first switch contact is coupled to a respective first conductor for each switch, a second switch contact is coupled to a respective second conductor or the second conductor for each switch. Each switch comprises a displaceable plunger, an end of which is adjacent a first contact for a respective switch. Respective second contacts of the switches are aligned with respective first contacts and respective plungers.

The interactive section comprises a third sheet extending between the first and second sheets between aligned first and second contacts of each switch. The third sheet has a plurality of holes therethrough each of which is aligned with a respective plunger, and has a thickness at least at the holes to separate respective first and second contacts of respective switches in an open state of a respective switch. The plungers are mounted to be axially displaceable towards respective first and second contacts by force applied to the first sheet in a respective active location and to be axially displaceable away from respective first and second contacts when such force is released, whereby axial displacement of a respective plunger towards respective first and second contacts pushes a respective first contact into electrical contact with a respective second contact through a respective hole to define a closed state of a respective switch.

The third sheet is of generally uniform thickness made of an elastically deformable material such that it is compressed at a respective hole during displacement of a respective plunger towards respective first and second switch contacts to facilitate electrical contact of respective first and second switch contacts and which relaxes at the holes during displacement of a respective plunger away from respective first and second switch contacts to facilitate separation of respective first and second switch contacts.

The interactive section comprises a fourth flexible sheet positioned between the first sheet and the third sheet, and a fifth flexible sheet positioned between the third flexible sheet and the second flexible sheet. The first and second conductors comprise conductive traces carried by the fourth and fifth flexible sheets, respectively. The first and second contacts comprise portions of respective traces which are aligned with respective holes in the third sheet and respective plungers.

The interactive section comprises another sheet made of elastically deformable material positioned between the second switch contacts and the second sheet. The third sheet and the another sheet are made of a resilient foam material. Alternatively, either or both the third and another sheet may be replaced by spaced smaller pieces located only in the switch areas.

In another embodiment, the active locations are electrically interconnected and connected to an electronic section by flexible conductors (e.g., wires), and physically interconnected by narrow flexible strips, e.g., flexible tubing in which the conductors are run.

The electronics section determines the sequence or sequences in which the lamps are energized, and the duration or durations for which they are energized as well as determining whether the player contacted the proper switch or switches within a given time or times, e.g., for the time or times that the lamp or lamps are energized.

In other embodiments, a visual prompt may be effected by the movement of an object rather than the lighting of a lamp, or the prompt may be or include audio.

BRIEF DESCRIPTION OF THE DRAWINGS

The invention is illustrated in the figures of the accompanying drawings which are meant to be exemplary and not limiting, in which like numerals in the different figures refer to like or corresponding parts, and in which.

Figure 1:
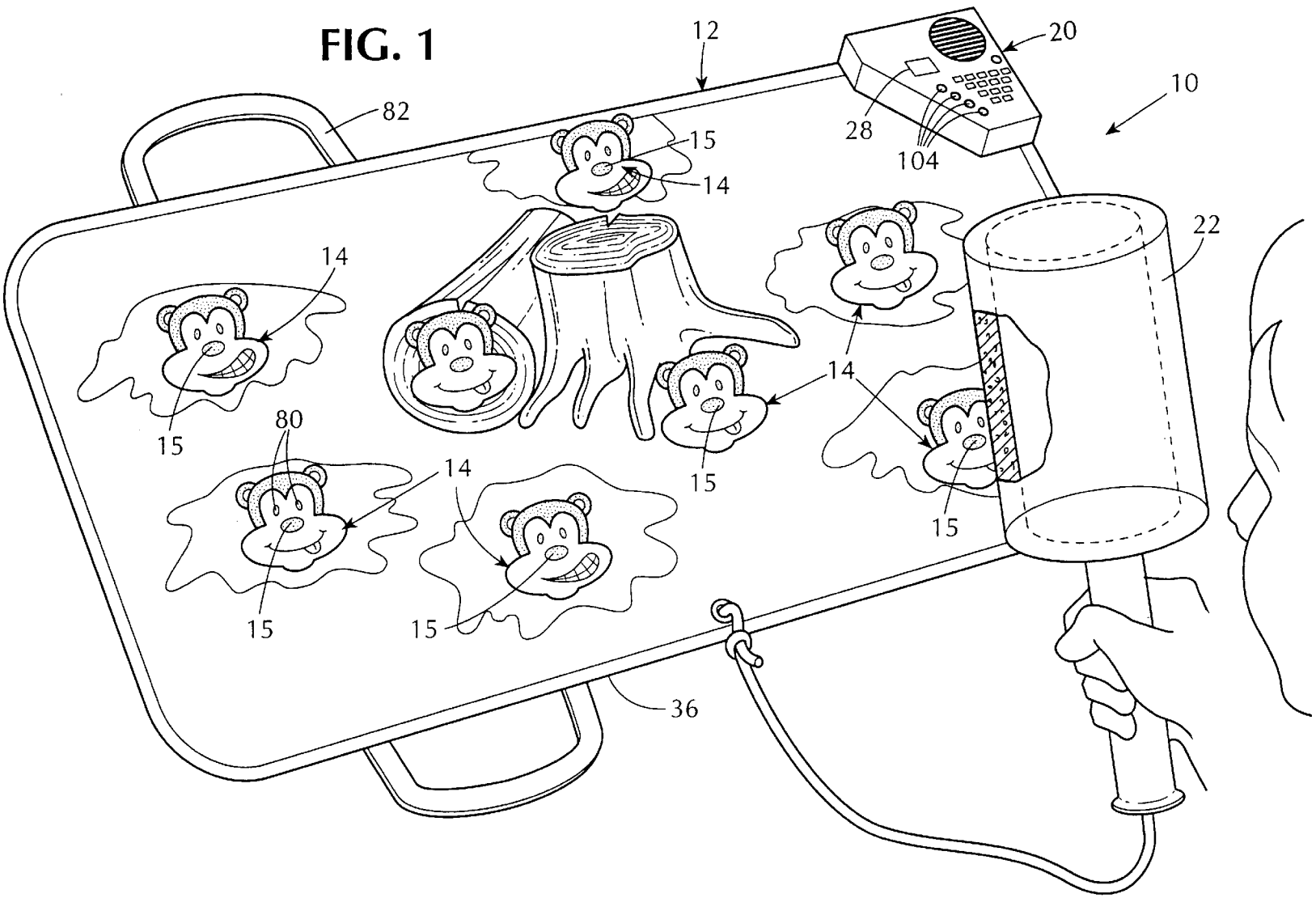
FIG. 1 is a perspective view of an electronic game, according to one embodiment of the invention, having a reconfigurable interactive play section and an electronics section.
Figure 3:
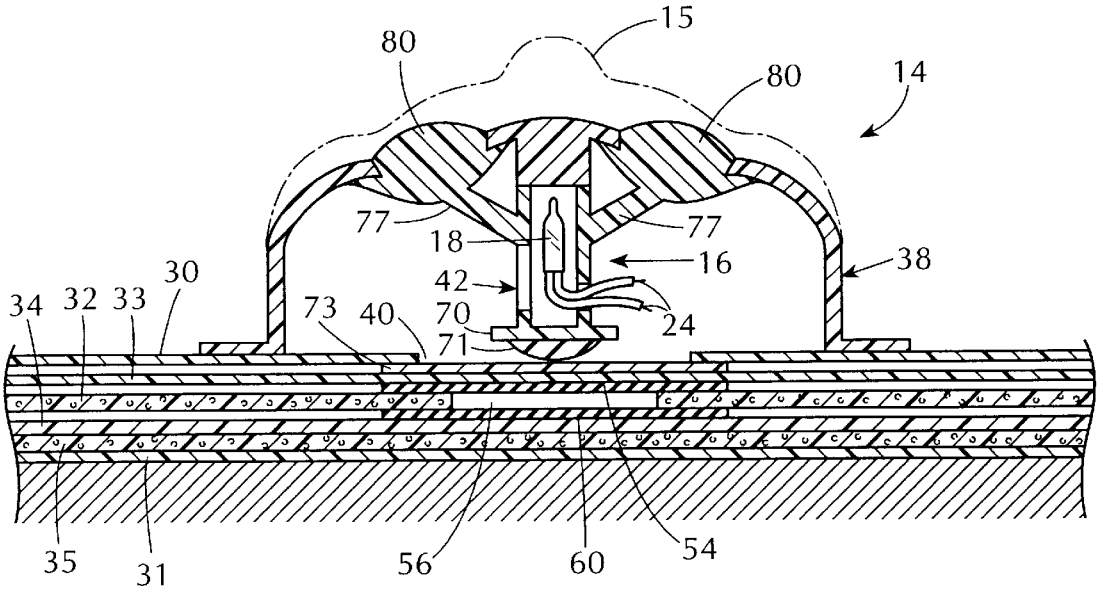
FIG. 3 is a sectional view through an active location of the interactive section of the electronic game depicted in FIG. 1 showing components of a switch in the active location with no force applied to it.
Figure 4:
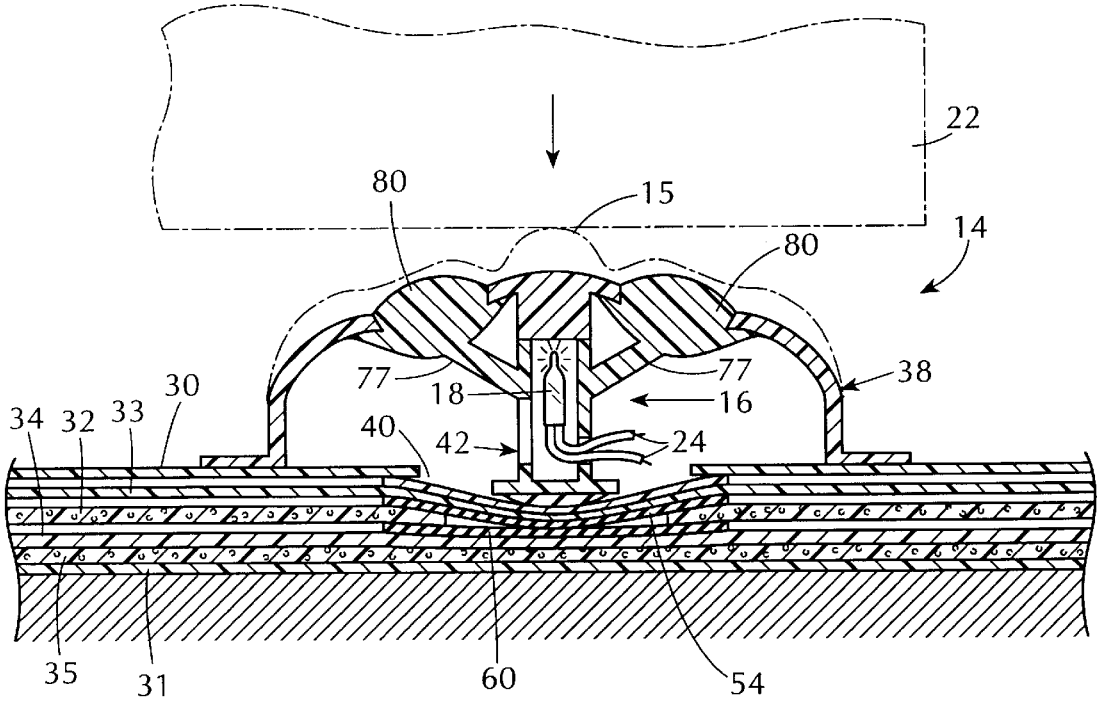
Figure 5:
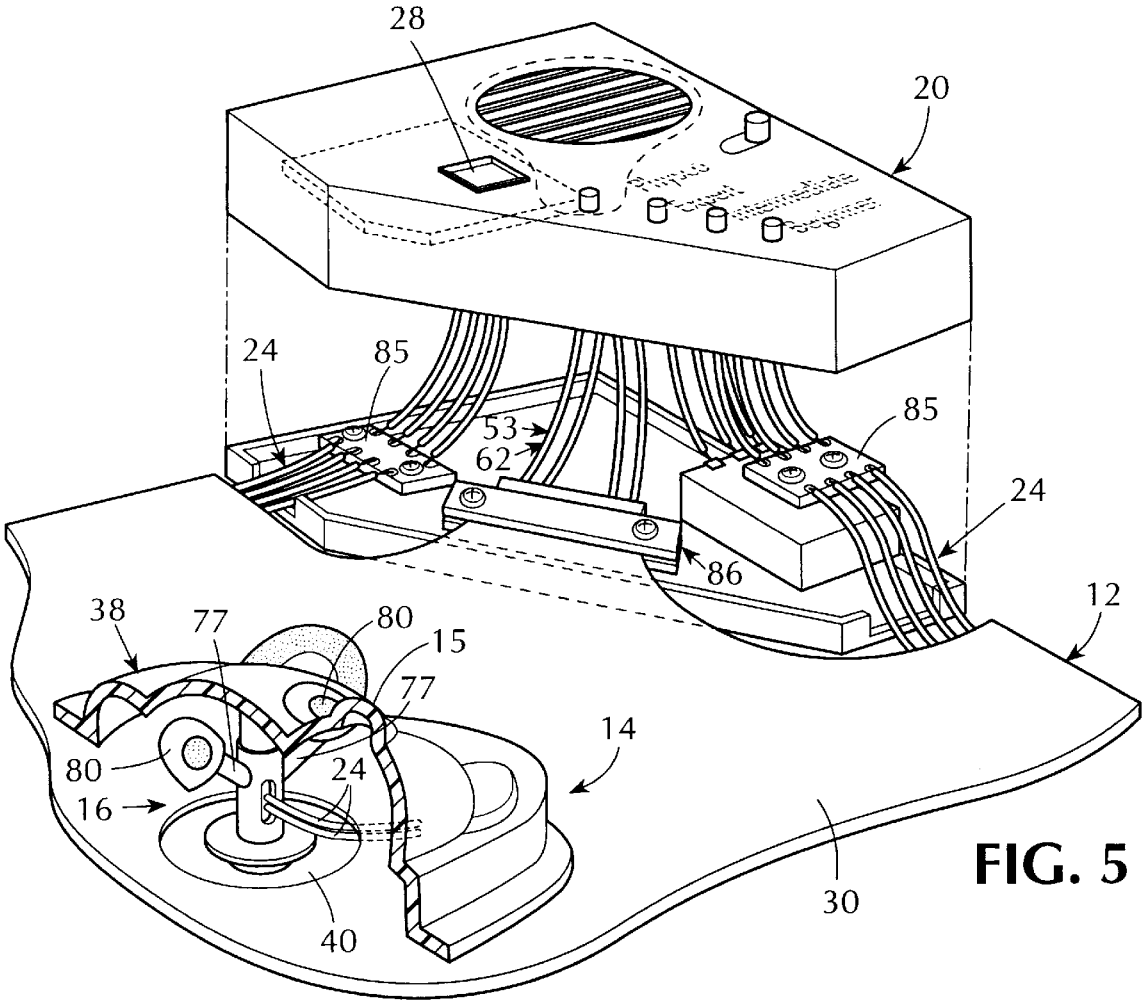
Figure 6:
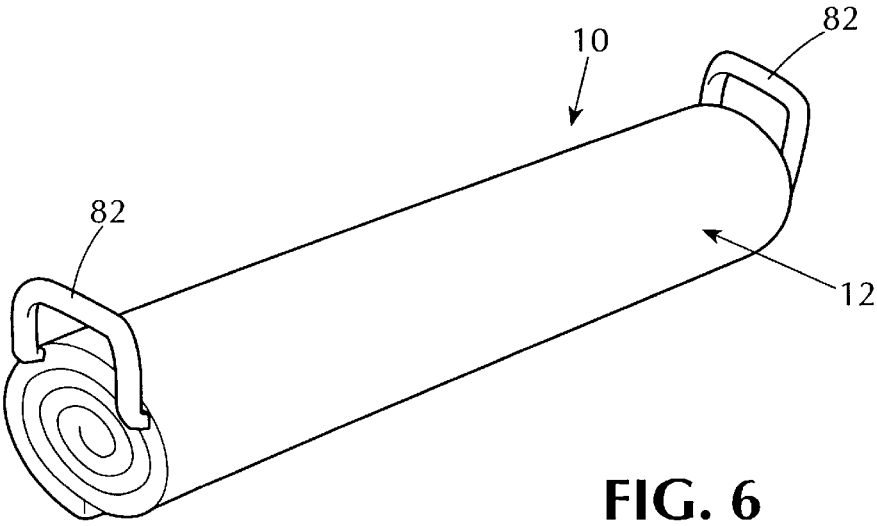
Figure 7:
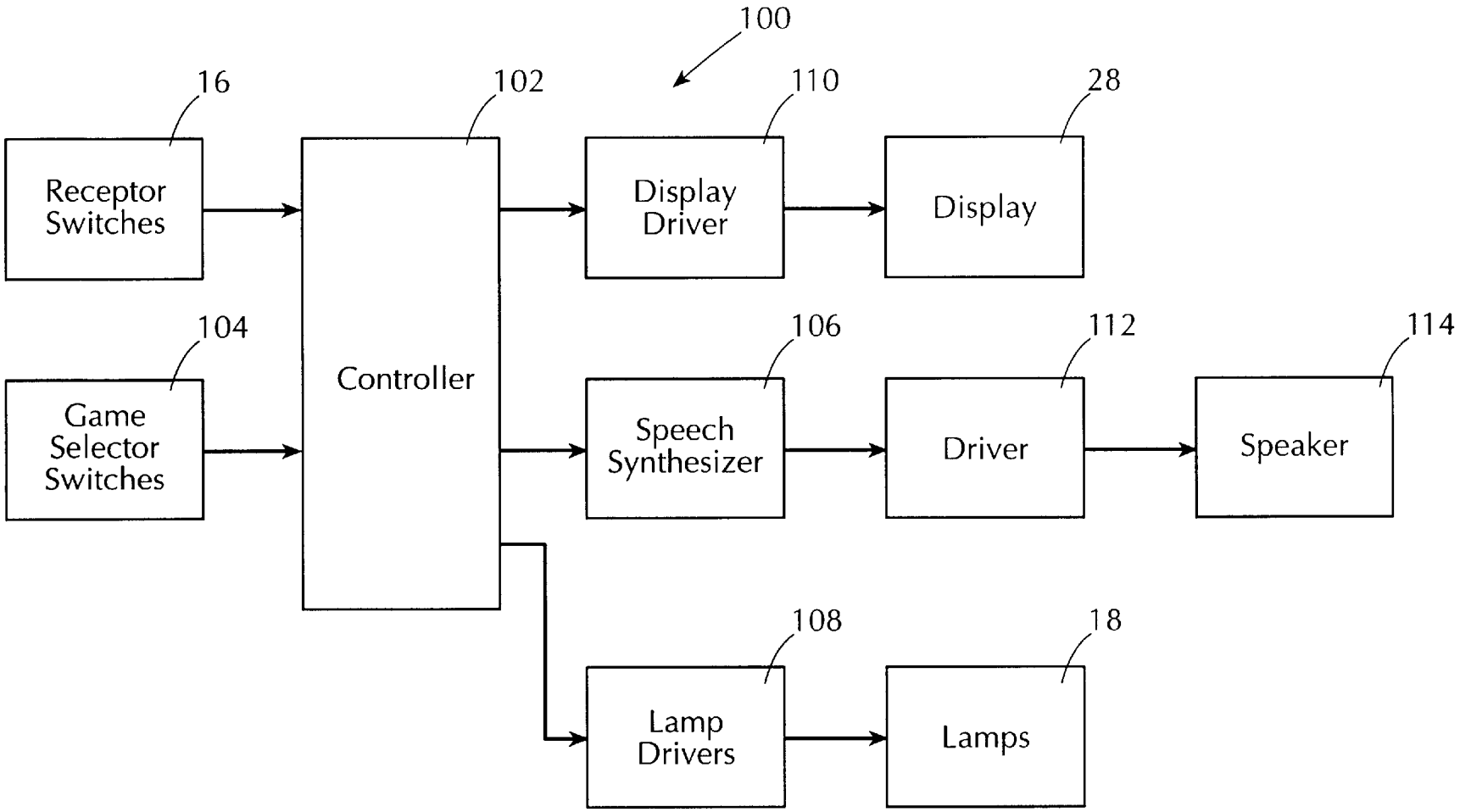
Figure 8:
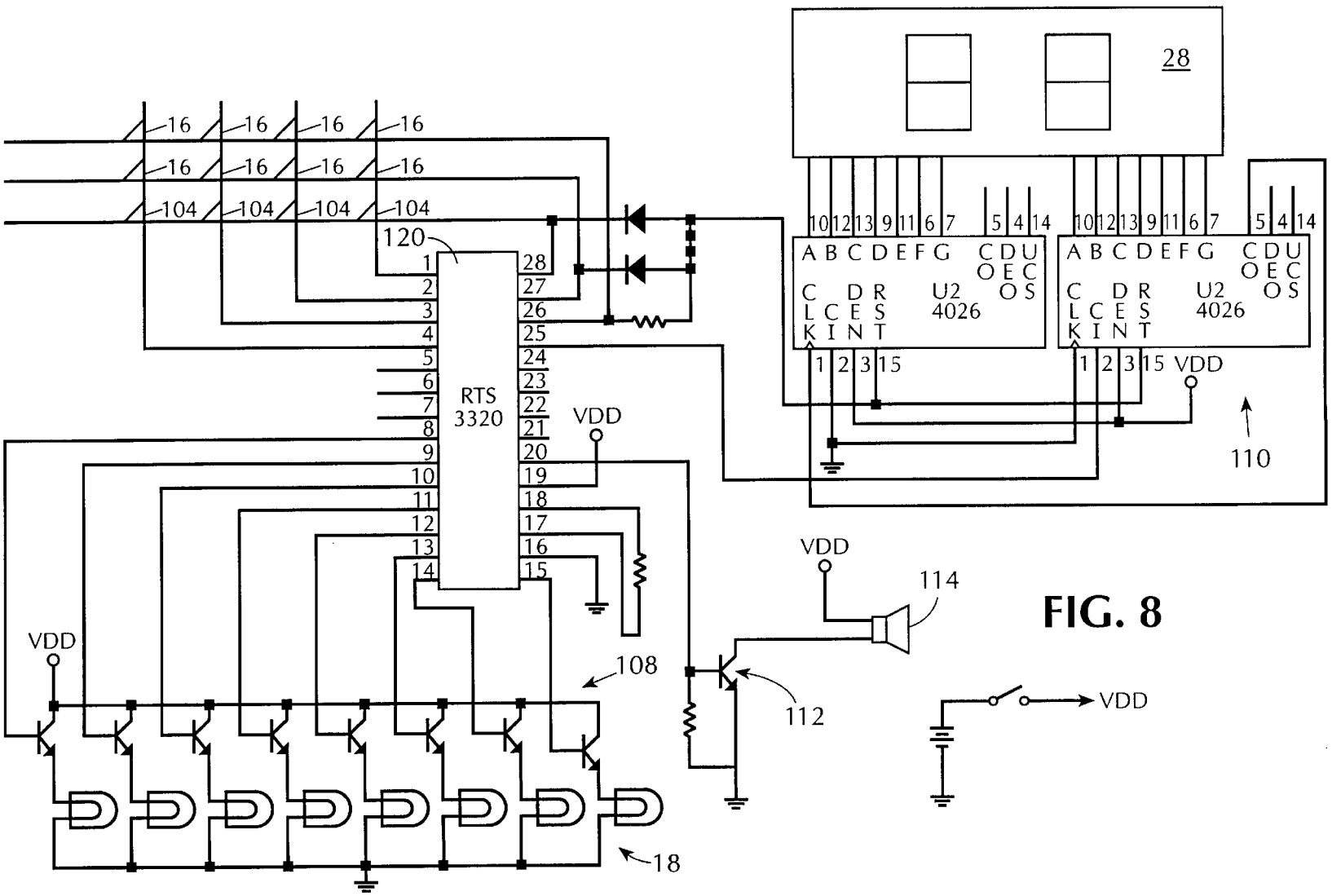
Figure 9:
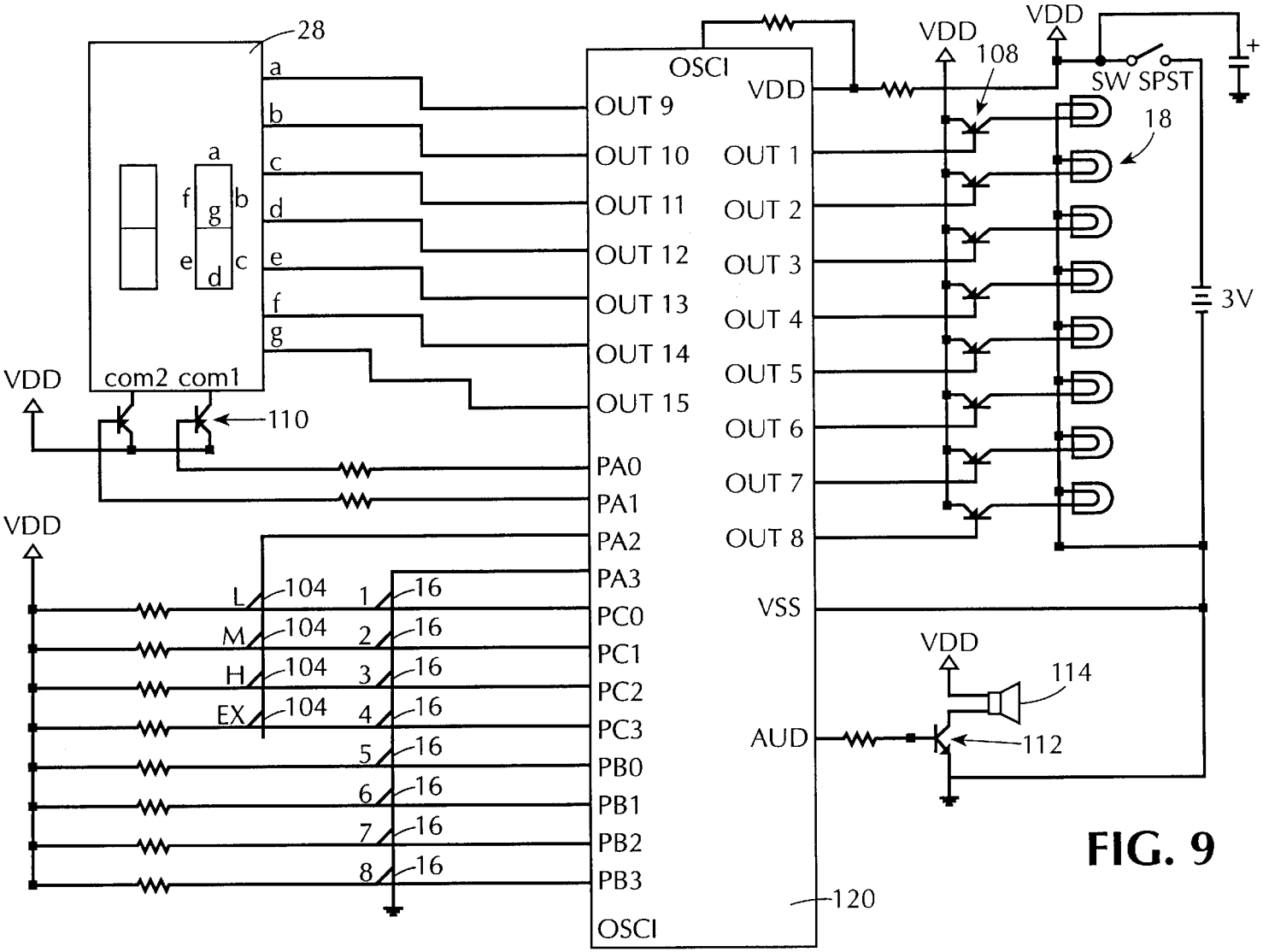
Figure 10:
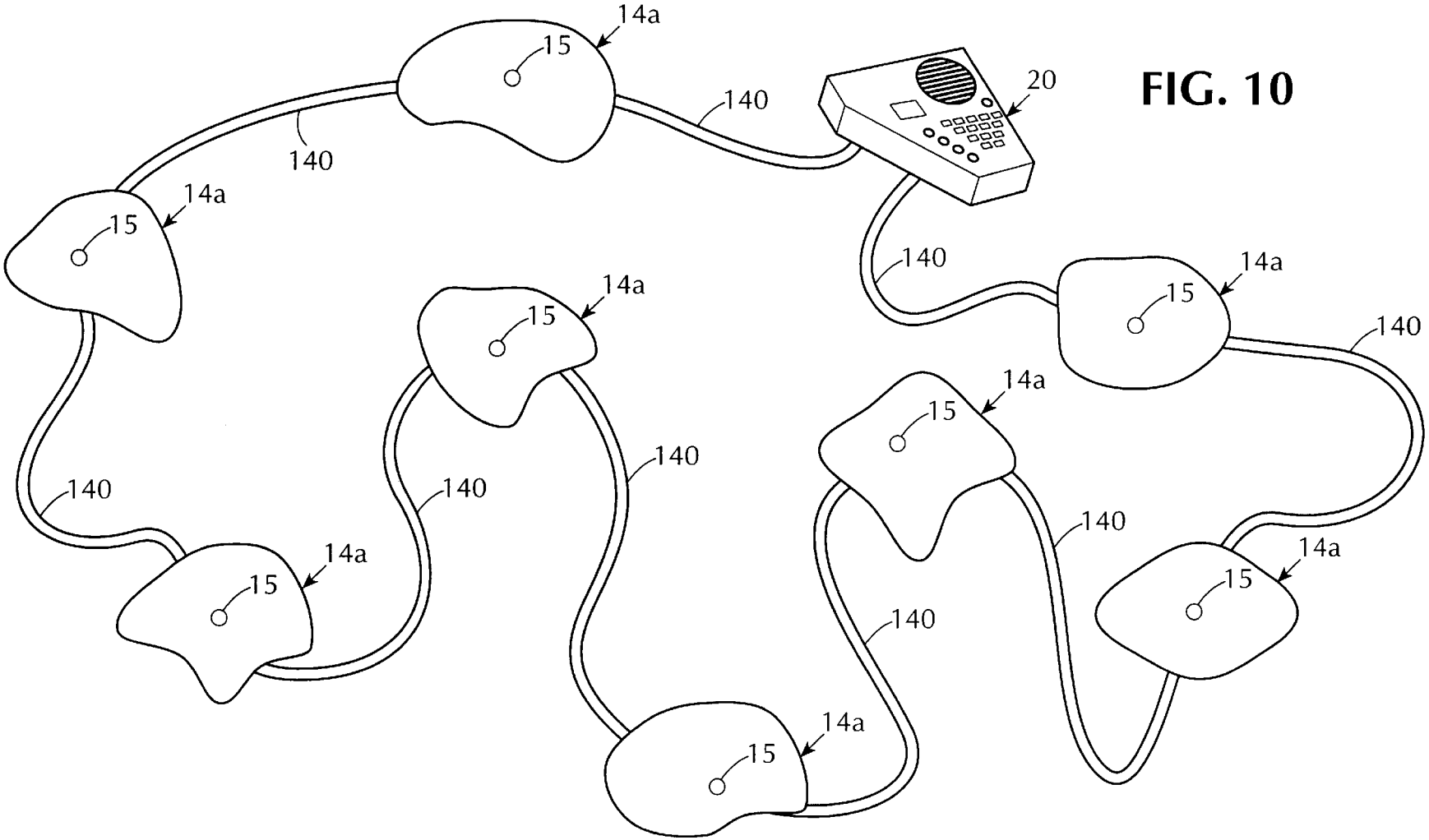

FIG. 4 is a sectional view similar to FIG. 3 but showing a mallet hitting the active area to depress and close the switch;

FIG. 5 is a perspective view of a portion of the interactive section and electronics section in the game depicted in FIG. 1, partially exploded showing connections of conductors in the interactive section with the electronics section and partially in section showing one of the switches;

FIG. 6 is a perspective view of the game depicted in FIG. 1 in a rolled-up configuration;

FIG. 7 is a block diagram of the electronic circuit of the game depicted in FIG. 1;

FIG. 8 is a schematic diagram of one embodiment of the electronic circuit of the game depicted of FIG. 1;

FIG. 9 is a schematic diagram of another embodiment of the electronic circuit of the game depicted in FIG. 1; and FIG. 10 is a schematic representation of another embodiment of the interactive section.

DESCRIPTION OF THE PREFERRED EMBODIMENTS

Referring to FIG. 1, the electronic game 10 according to one embodiment of the invention has a flexible interactive section 12, which has a plurality of active locations 14 each including a switch 16 (FIG. 3) and a lamp 18 (FIG. 3), and an electronics section 20 (FIGS. 1, 5 and 7–9). The active locations 14 portray a fanciful figure, in this case a skunk's head as illustrated in FIG. 1. Hitting a target area 15 of an interactive location 14, here the nose of a skunk head, with one's hand, or preferably a mallet 22, closes the respective switch 16. The electronics section 20 causes the lamps 18 in the interactive locations 14 to light in a sequence which appears random for a predetermined short time via respective conductors 24 (FIGS. 3–5) connected to the lamps and to the electronics section 20, and detects the closings of switches 16 via respective switch circuits described below which comprise conductors 50 and 58. The object of the game is for the player to close the switch 16 of the active location whose lamp is energized within a predetermined time, e.g., before the lamp is deenergized. This is done by striking the target area 15. The game is played by placing the interactive section 12 on a flat surface. The electronics section 20 detects timely switch closures or "hits" and provides a score based on accumulated hits over time.

The game 10 thereby tests a player's reaction time and coordination, and players can compete for the best score. Enormous play value can be achieved in such a game with its large interactive section 12 at low cost and without permanently occupying a large space. Thus, the play value of an arcade game may be provided in the home by an inexpensive game that may be rolled up and compactly stored when not in use.

The electronics section 20 provides the capability of varying parameters of the game such as game difficulty (e.g., the length of time a lamp is energized, and/or the number and locations of lamps energized at the same time, and/or the sequence of lamp energization, etc.), the time length of each game, scoring levels which qualify for skill designations or which end a game, etc. The electronics section 20 includes a display 28 for displaying scores, and may include audio coordinated with lamp energization and/or successful hits and/or scoring and/or game start and/or end. These features provided by the electronics section and the large area interactive section enable the inexpensive and compactly reconfigurable game 10 disclosed herein to resemble an arcade-type game, which tremendously enhances the play value of the game.

Figure 2:
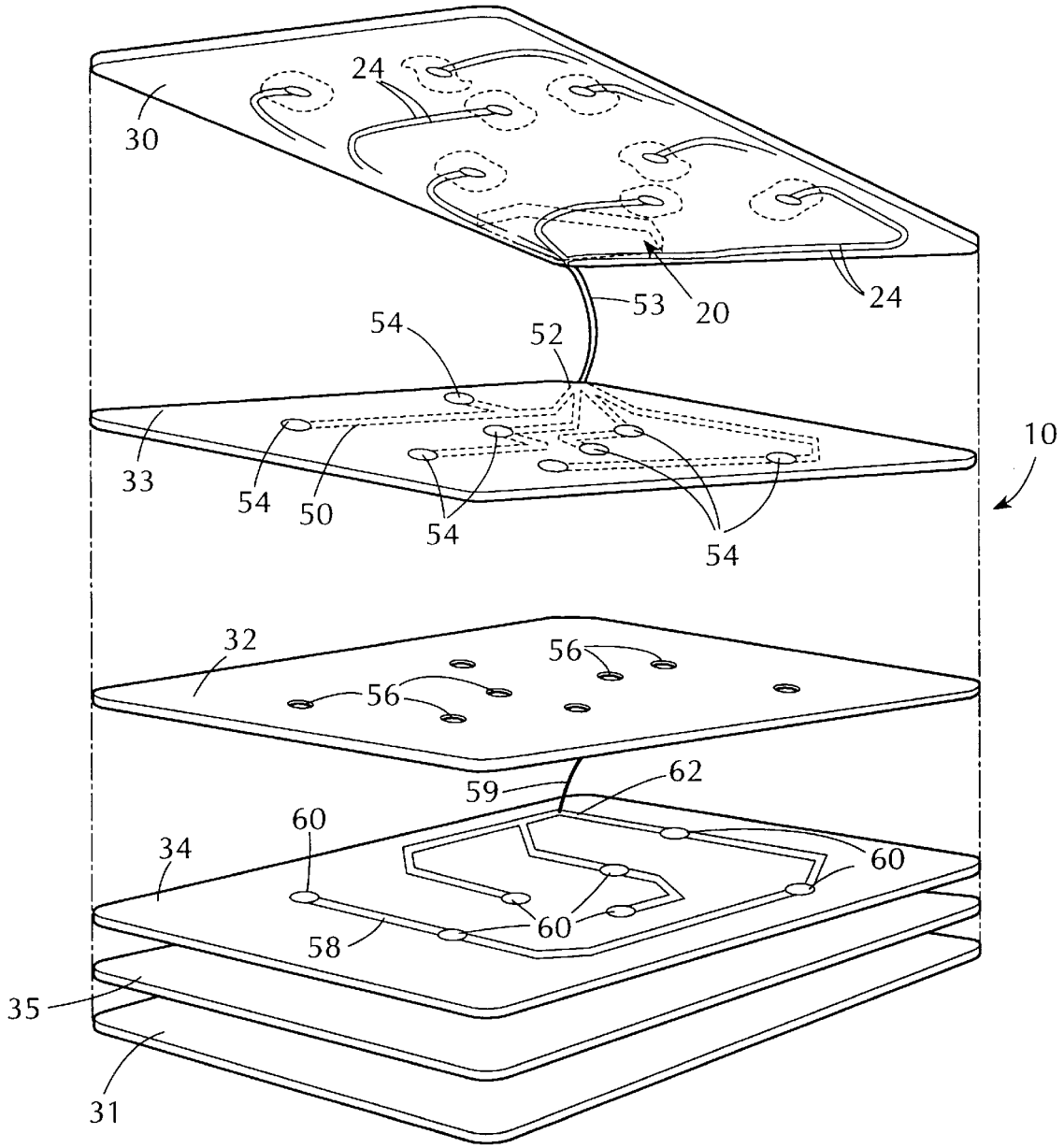
FIG. 2 is an exploded perspective view of the interactive play section of the electronic game depicted in FIG. 1.

Referring to FIGS. 2–4, the interactive play section 12 comprises a plurality of coextensive and superposed flexible sheets 30–35, as follows: first or outer top sheet 30, second or outer bottom sheet 31, third or switch circuit separation sheet 32, fourth or top switch circuit sheet 33, fifth or bottom switch circuit sheet 34, and sixth or switch backing sheet 35. Sheets 30–35 are held together along their peripheries by a stitched welt 36 (FIG. 1) or by any suitable means. The top switch circuit sheet 33, the switch circuit separation sheet 32 and the bottom switch circuit sheet 34 are preferably also held together inwardly of their peripheries by stitching (not shown) or by any suitable means to provide a sub-assembly. The sheets 30–35 are not mounted in a rigid frame or support, and the game is played simply by placing the interactive section 12 on a flat surface like a table top or the floor.

The outer top sheet 30 (FIG. 3) has affixed to the outer side thereof in the active locations 14 flexible cup-shaped elements 38 configured and decorated to resemble a skunk's head. The surrounding areas and other areas of the interactive section 12 may be decorated to depict a scene, background or environment compatible with the skunk heads, for example as depicted in FIG. 1. Any suitable means may be used to affix the cup-shaped elements 38 to the outer top sheet 30. For example, where the outer top sheet 30 and the cup-shaped elements 38 are both made of plastic material, the cup-shaped elements 38 may be heat fused to the sheet 30. The outer top sheet 30 has holes 40 in each active location 14 below each cup-shaped element 38 which enable a switch plunger 42 (FIG. 3) of a switch 16 to pass therethrough to close a switch circuit as described below.

The top switch circuit sheet 33 carries conductors 50 (FIG. 2), one for each active location, which extend from a respective active location 14 to a location 52 at a corner of the sheet 33 where they then pass to the electronics section 20 via a bundle of wires 53. Sheet 33 also carries conductor portions 54 aligned with respective holes 40 and respective switch plungers 42. The switch circuit separation sheet 32 has holes 56 therein aligned with the conductor portions 54 carried by top switch circuit sheet 33. The bottom switch circuit sheet 34 carries a conductor 58 having conductor portions 60 aligned with respective holes 56 in the switch circuit separation sheet 32. The conductor 58 extends from a location 62 in the corner of the bottom switch circuit sheet 34 below the location 52 in sheet 33, from which the conductor 58 passes to the electronics section 20 via a wire 59. The conductive portions 54 and 60 function as switch contacts as described below. Depending on the width of conductors 50 and 58, conductor positions 54 and 60 may be enlarged as shown. The conductors 50 and 58 are electrically connected as shown in the circuit diagrams of FIGS. 8 and 9, and are connected to ground, a voltage level and/or a circuit clement in the electronics section 20, as shown in FIGS. 8 and 9.

All of the sheets 30–35 in the preferred embodiment are made of plastic. (They are not shown to scale in the drawings.) The outer top sheet 31 is made of a wear resistant plastic such as polyvinylchloride (PVC) in a suitable thickness, e.g., about 0.2 mm. The outer bottom sheet 35, similar to the outer top sheet 30, has wear resistant properties, and may be made of PVC, of, e.g., 0.13 mm thickness. The top and bottom switch circuit sheets 33 and 34 are made of a plastic e.g., polyethylene, on which conductors 50 and 58 may be printed or deposited as conductive traces, and are relatively thin, e.g., 0.13 mm, so as to be easily deformed by the switch plunger 42, as described below.

The switch circuit separation sheet 32 has sufficient thickness to separate conductive portions 54 and 60 aligned with respective holes 56 on opposite sides of sheet 32, and preferably is elastically deformable or resilient. In order to attain sufficient thickness with minimal weight and material, sheet 32 is made of a foamed plastic, e.g., PVC of, e.g., 0.30 mm thickness. Use of a foamed plastic also imparts elastic deformation properties to the sheet 32, which may assist switching action as described below.

The switch backing sheet 35 also is elastically deformable to assist switching, action as described below. For example, sheet 34 may be made of foamed plastic. e.g., PVC, of, e.g., 0.30 mm thickness. The switch backing sheet 35 may be replaced by separate disc-shaped pieces located below conductive portions 60 sized at least as large and preferably larger than conductive portions 60.

Conductors 50 and 58 may be embodied by wires instead of conductive traces. In that embodiment: the respective wires would carry respective conductive portions 54 and 60, which may be embodied by conductive metal discs, for example; the discs and wires may be attached to opposite sides of the switch circuit separation sheet 32; and the sheets 33 and 34 may be omitted. The switch current separate sheet 32 may be replaced by separate pieces located between conductive portions 54 and 60, each having a hole 56 aligned with the conductive portions 54 and 60.

The switches 16 close and open respective switch circuits extending on the switch circuit sheets 33 and 34 to the electronics section 20 by electrically contacting and separating conductive portions 54 and 60 of the circuits on the respective sheets 33 and 34 below the respective target areas 15. This switching action is described below for one switch 16 and is applicable to all of the switches 16.

With reference to FIGS. 3–5, each switch 16 comprises the switch plunger 42, which is embodied as an elongated rigid element contacting the cup-like clement 38 in the target area 15 in a central region thereof. The cup-like element 38 is made of flexible material so that when it is hit by a player's hand or the mallet 22 in the central region thereof, the cup-like element 38 flexes downwardly to displace the switch plunger 42 downwardly towards the conductive portions 54 and 60, as illustrated in FIG. 4. The cup-like elements 38 are suitably constructed to achieve this action. The switch plunger 42 includes a base 70 having a curved or rounded protrusion 71 facing the conductive portions 54 and 60. The rounded protrusion 71 is relatively rigid and when moved downwardly presses the conductive portion 54 on sheet 33 through a hole 56 in the switch circuit separation sheet 32 into contact with a conductive portion 60 on sheet 34, as shown in FIG. 4. This pressing action of the switch plunger 42 also elastically compresses the switch circuit separation sheet 32 in the area thereof surrounding the hole 56, and elastically compresses the compressible switch backing sheet 34 in the area thereof below conductive portions 54 and 60.

The switch circuit separation sheet 32 is made elastically compressible to assist in separating the conductive portions 54 and 60 after they have been pressed together by downward displacement of switch plunger 42, and the switch backing sheet 34 is made elastically compressible to provide a compliant backing for the conductive portions 54 and 60 so that they conform to the rounded shape of the protrusion 71 and thereby provide a larger surface area of contact. Also, the switch backing sheet 34 is made compressible to absorb some of the force with which the target area 15 is hit, which would otherwise have to be absorbed by the protrusion 71 and the sheets themselves. Such absorption reduces wear on the sheets 30–35 and the protrusion 71, improves the feel of hitting the switch, and also assists in rebounding of the switch plunger 42 (axial displacement away from conductive portions 54 and 60) after the target area 15 was hit.

A bearing layer 73 in the form of a flexible disc is provided on the top switch circuit sheet 33 where it is contacted by the rounded protrusion 71 of the switch plunger 42 to reinforce the sheet 33 and provide a better bearing surface to the rounded protrusion 71. After being hit, a cup-like element 38 recovers to the position shown in FIG. 3 to retract the rounded protrusion 71 of the switch plunger 42 from contact with the bearing layer 73 of the sheet 33. As mentioned above, the elastically deformable switch backing sheet 34 assists in this retraction by providing a rebounding action. When the switch plunger 42 retracts to the position shown in FIG. 3, the switch circuit separation sheet 32 recovers from the compressed configuration shown in FIG. 4 to the relaxed configuration shown in FIG. 3, and in doing so assists in separating the conductive portions 54 and 60 of sheets 33 and 34.

Still referring to FIGS. 3–5, struts 77 connected to the switch plunger 42 also contact the cup-like element 38. At least one of the struts 77 or the switch plunger 42 is connected to the cup-like element 38 in order to lift the switch plunger 42 to retract or axially displace it away from conductive portions 54 and 60 after the cup-like clement 38 has been hit. In the embodiment shown in FIGS. 3–5, the top of the struts 77 and the top of the switch plunger 42 are connected to the cup-like element 38. The struts 77 stabilize connection of the switch plunger 42 to the cup-like element 38 and also function to flex the cup-like clement 38 when it is struck, particularly by a slightly off-target blow.

The cup-like elements 38 include light conductive portions 80, here the eyes of the skunk heads, which transmit light from a respective lamp 18 when it is illuminated. Advantageously, the struts 77 and the central part of the switch plunger 42 are made of light transmitting material, so that light from a lamp 18 in the hollow central part of the switch plunger 42 is conducted to the top ends of the struts 77 and to the light transmitting portions 80 in the cup-like elements 38. A respective pair of conductors 24, in this embodiment insulated wires, connects each lamp 18 to the electronics section 20.

The cup-like element 38 is made of a suitable flexible plastic material configured to be self-supporting but somewhat collapsible after being struck on its convex (top) side and able to flex back to its original configuration. The struts 77 and the switch plunger 42 are made of a suitable light transmitting material, which though relatively rigid may also be flexible to absorb some of the force when the up-like element 38 is hit. The light transmitting portions 80 may be made of the same material as the struts 77. The protrusion 71 may be made of a suitable relatively hard elastomeric material.

The interactive section 12 may be constructed and assembled using conventional manufacturing techniques, and the different components may be attached conventionally using heat bonding or fusing, ultrasonic bonding, adhesives and/or stitching, as appropriate for the particular components and the material or materials of which they are made. As constructed, the interactive section is flexible and may be rolled into the compact configuration shown in FIG. 6. Handles 82 for carrying game 10 are attached to the top outer sheet 30.

Summarizing operation of the interactive section 12, the electronics section 20 randomly or pseudorandomly illuminates one or more lamps 38 at a time for a short period of time during which a player is to strike the target area 15 of the interactive is location or locations whose lamp or lamps are illuminated before it or they are turned off. Striking a target area 15 closes a respective switch 16 as described above, and if accomplished before the respective lamp 38 is turned off, as shown in FIG. 4, is registered as a hit by the electronics section 20.

Referring to FIG. 5, the electronics section 20 includes terminals 85 for connecting the conductors 24 (wires) from the lamps to the electronics section 20, and a terminal 86 for connecting conductors 50 and 58 of the switch circuits to the electronics section 20. Referring to FIG. 7, an electronics circuit 100, part of which is housed within the electronics section 20, includes a controller 102 which receives inputs from receptor switches 16 and the game selector switches 104 (see FIG. 1), and provides outputs to a speech synthesizer 106, lamp drivers 108 and displayer driver 110. The speech synthesizer 106 provides audio signals to a driver 112 which amplifies the signals and provides them to speaker 114. The display driver 110 supplies display signals to display 28, and the lamp drivers 108 supply signals at a suitable level to illuminate lamps 18. The controller 102 is programmed to provide signals to the lamps 18 via lamp drivers 108 to selectively illuminate the lamps for predetermined periods of time in a random or apparently random pattern, and to sample closures of the switches 16 to identify and record hits.

The controller 102 is programmed to also controls energization of the display 28 to display the number of hits registered by the electronics section. The controller is programmed to control the speech synthesizer 106 to provide audio signals to the speaker 108 via the driver 112 to sound appropriate short messages, and tunes at the appropriate times on speaker 114 such as a hit sound, a missed sound, and phrases such as "you missed me", "time is running out", "you're awesome", "try again", "next level", "the winner", etc.

The controller 102 is further programmed to advance the number displayed on display 28 up to 99 with each hit that is registered. Game selector switches 104 set the tempo of the game, i.e., control the length of time that a lamp is illuminated and during which the controller 102 will register a hit for the active location 14 of the illuminated lamps. This time may be from about 0.5 seconds to 2 seconds, selected by switches 104. Controller 102 is also programmed to control the total playing time, e.g., 30 seconds, and to automatically advance the tempo to the next level when say an 80% success rate is achieved. Many variations will be apparent to those of skill in the art, and circuits and programs for implementing circuit 100 will be apparent to those of skill in the art.

For example the electronics circuit 100 may be embodied by the circuits represented in FIGS. 8 and 9. In FIGS. 8 and 9, the integrated circuit 120 includes the controller 102 and the speech synthesizer 106, and is commercially available as RTS 3320 (FIG. 8) and UM5253 (FIG. 9). The display controller 120 and the transistors 110 in FIG. 9 perform the functions of the display drivers 110 in FIG. 8. The drivers 110 are commercially available 4026 integrated circuits (FIG. 8). Equivalent integrated circuits are known to those of skill in the art.

Referring to FIG. 10, the game 10*a* has an interactive section 12*a* formed by active locations in the form of separate active elements 14*a* which are physically connected together by sections of flexable tubing 140 and electrically connected to the electronics section 20 by wires (not shown which replace conductive traces 50, 50*a*) and wires (also not shown, but the same as wires 24) connected to the lamps. Each active element 14*a* may include a target area 15 and may be constructed as described and shown for active areas 14, but with wires instead of conductive traces. Thus, each active element 14*a* may be a self-contained active location 14, but not sharing any common sheets or layers as in the embodiment of FIGS. 1–6. Each active element 14*a* is sealed about its periphery to maintain the relationship of the parts thereof shown in FIGS. 3 and 4. The wires are run within flexible plastic tubing 140 which are securely attached to the active elements 14*a*. The tubing 140 therefore interconnects the active elements 14*a* and performs the physical connecting function of the sheet portions between the active locations 14 in the embodiment of FIGS. 1–6. The sections of tubing 140 may be of the same length or generally the same length, or of different lengths. The lengths are selected so as to allow the active elements 14*a* to be positioned suitably for a given game or generally for a number of games.

As in the game 10 of FIGS. 1–6, the game 10*a* may be reconfigured to occupy a space with a largest side having an area that is substantially less then half the area of the interactive section 12*a* when it is laid out in a play configuration.

While the invention has been described and illustrated in connection with preferred embodiments, many variations and modifications, as will be evident to those skilled in this art, may be made without departing from the spirit and scope of the invention. For example, the invention has application to other types of games, e.g., a "Simple Simon" type of game where prompts indicate actions to be taken by a player and the interactive section detects compliance, or to a "Twister" type game where persons have to stretch and maintain contact between active locations. Also, devices other than lamps may be used to prompt and receptor devices other than switches maybe used to detect responses. The invention as set forth in the appended claims is thus not to be limited to the precise details of construction set forth above as such variations and modifications are intended to be included within the spirit and scope of the invention as defined in the appended claims.

We claim:

1. An interactive electronic game comprising an interactive section and an electronics section, said game providing prompts to a player and receiving and scoring the player's responses;

said interactive section including prompting circuitry and one or more prompters which provide said prompts, or receptor circuitry and one or more receptors which receive said responses, or both, a plurality of active locations which each include a prompter or part thereof, or a receptor or part thereof, or both, said prompting circuitry and said receptor circuitry being coupled to said electronics section, said interactive section having a playing configuration with a largest side having a first area and a non-playing configuration with a largest side having a second area which is less than half of the first area, said interactive section including a flexible portion or portions so as to be reconfigurable from said playing configuration to said non-playing configuration and from said non-playing configuration to said playing configuration.

2. The electronic game of claim 1 wherein said one or more prompters comprise discrete devices, or said one or receptors comprise discrete devices, or both.

3. The electronic game of claim 1 wherein said interactive section includes both said prompting circuitry and said one or more prompters, and said receptor circuitry and said one or more receptors.

4. The electronic game of claim 1 wherein said one or more receptors detect the presence on or in close proximity thereto of an object which a player selectively moves onto or in close proximity to said one or more receptors to provide a response to a prompt.

5. The electronic game of claim 1 wherein said one or more prompters provide visually perceptible prompts.

6. The electronic game of claim 5 wherein said one or more prompters comprise discrete indicator devices, or said one or receptors comprise discrete devices, or both, and wherein each active location of said interactive section includes a discrete indicator device, or a discrete receptor device, or both.

7. The electronic game of claim 6 wherein each discrete receptor device comprises a force responsive device which senses the presence of the object when forced against the respective active location.

8. The electronic game of claim 7 wherein the force responsive device is an electrical switch coupled to said receptor circuitry so as to close or open a circuit when the object is forced against the respective active location.

9. The electronic game of claim 8 wherein said receptor circuitry comprises electrical conductors coupling each electrical switch to said electronics section, said electrical conductors and said electronics section cooperating to detect a change in status of said electrical switches so as to identify which particular switches or switches experienced a change in status at a given time.

10. The electronic game of claim 9 wherein said flexible portions of said active locations do not include a switch and wherein said conductors are flexible at least in said flexible portions of said interactive section.

11. The electronic game of claim 6 wherein said prompter circuitry comprises electrical conductors coupling each discrete indicator device to said electronics section, said electrical conductors and said electronics section cooperating to selectively cause said indicator devices to change state so as to prompt to a particular active location or locations.

12. The electronic game of claim 6 wherein each discrete indicator device comprises a lamp.

13. The electronic game of claim 11 wherein said flexible portions of said active locations do not include a switch and wherein said conductors are flexible at least in said flexible portions of said interactive section.

14. The electronic game of claim 5 wherein said one or more prompters comprise discrete indicator devices and said one or receptors comprise discrete devices, and wherein each active location of said interactive section includes both a discrete indicator device and a discrete receptor device.

15. The electronic game of claim 14 wherein each discrete receptor device comprises a force responsive device which senses the presence of the object when forced against the respective active location.

16. The electronic game of claim 15 wherein the force responsive device is an electrical switch coupled to said receptor circuitry so as to close or open a circuit when the object is forced against the respective active location.

17. The electronic game of claim 16 wherein said receptor circuitry comprises first electrical conductors coupling each electrical switch to said electronics section, said first electrical conductors and said electronics section cooperating to detect a change in status of said electrical switches so as to identify which particular switches or switches experienced a change in status at a given time, and wherein said prompter circuitry comprises second electrical conductors coupling each discrete indicator device to said electronics section, said second electrical conductors and said electronics section cooperating to selectively cause said indicator devices to change state so as to prompt to a particular active location or locations.

18. The electronic game of claim 17 wherein said flexible portions of said active locations do not include a switch and wherein said first and second conductors are flexible at least in said flexible portions of said interactive section.

19. The electronic game of claim 6 wherein each discrete indicator device comprises a lamp.

20. The electronic game of claim 1 wherein said flexible portion or portions comprise one or more sheets interconnecting said active locations.

21. The electronic game of claim 1 wherein said flexible portion or portions comprise one or more flexible strips interconnecting said active locations.

22. The electronic game of claim 21 wherein said strips are sections of flexible tubing in which are run flexible electrical conductors electrically connected to active locations connected by a section of flexible tubing.

23. An interactive electronic game comprising an interactive section and an electronics section, said game providing prompts to a player and receiving and scoring the player's responses;

said interactive section including prompting circuitry and a plurality of discrete indicator devices which each provide visually perceptible prompts, receptor circuitry and a plurality of discrete receptor devices which each receive said responses, a plurality of active locations which each include an indicator device and a receptor device, said prompting circuitry and said receptor circuitry being coupled to said electronics section, said interactive section having a playing configuration with a largest side having a first area and a non-playing configuration with a largest side having a second area which is at less than half of the first area, said interactive section including a flexible portion or portions so as to be reconfigurable from said playing configuration to said non-playing configuration and from said non-playing configuration to said playing configuration.

24. The electronic game of claim 23 wherein said receptors detect the presence on or in close proximity thereto of an object which a player selectively moves onto or in close proximity to a respective active location to provide a response to a prompt at that active location.

25. The electronic game of claim 24 wherein each discrete receptor device comprises a force responsive device which senses the presence of the object when forced against the respective active location.

26. The electronic game of claim 25 wherein each force responsive device is an electrical switch coupled to said receptor circuitry so as to close or open a circuit when the object is forced against the respective active location.

27. The electronic game of claim 23 wherein said receptor circuitry comprises first electrical conductors coupling each electrical switch to said electronics section, said first electrical conductors and said electronics section cooperating to detect a change in status of said electrical switches so as to identify which particular switches or switches experienced a change in status at a given time, and wherein said prompter circuitry comprises second electrical conductors coupling each discrete indicator device to said electronics section, said second electrical conductors and said electronics section cooperating to selectively cause said indicator devices to change state so as to prompt to a particular active location or locations.

28. The electronic game of claim 27 wherein said flexible portions of said active locations do not include a switch and wherein said first and second conductors are flexible at least in said flexible portions of said interactive section.

29. The electronic game of claim 23 wherein each discrete indicator device comprises a lamp.

30. The electronic game of claim 23 wherein said flexible portion or portions comprise one or more sheets interconnecting said active locations.

31. The electronic game of claim 23 wherein said flexible portion or portions comprise one or more flexible strips interconnecting said active locations.

32. The electronic game of claim 31 wherein said strips are sections of flexible tubing in which are run flexible electrical conductors electrically connected to active locations connected by a section of flexible tubing.

33. An interactive electronic game comprising an interactive section and an electronics section, said game providing prompts to a player and receiving and scoring the player's responses;

said interactive section including a plurality of discrete indicator devices which each provide visually perceptible prompts, a plurality of discrete electrical switches, and a plurality of spaced active locations which each include an indicator device and a switch, said indicator devices and said switches being coupled to said electronics section by flexible conductors, said interactive section comprising at least first and second flexible sheets between which said conductors extend coupling respective indicator devices and said electronics section and coupling respective switches and said electronics section, said interactive section having a playing configuration with a largest side having a first area and a non-playing configuration with a largest side having a second area which is at least one third of the first area, said interactive section being flexible at least between said active locations so as to be foldable or rollable from said playing configuration to said non-playing configuration and unfoldable or unrollable from said non-playing configuration to said playing configuration.

34. The electronic game of claim 33 wherein each discrete indicator device comprises a lamp.

35. The electronic game of claim 33 wherein said conductors coupling respective switches to said electronic section comprise first conductors each coupling a first side of a respective switch to said electronics section and a second conductor or conductors which couple a second side of each switch to said electronics section, a first switch contact coupled to a respective first conductor for each switch, a second switch contact coupled to a respective second conductor or said second conductor for each switch, each switch comprising a displaceable plunger, an end of a respective plunger being position adjacent a first contact for a respective switch and respective second contacts being aligned with respective first contacts and respective plungers, said interactive section comprising a third sheet extending between said first and second sheets between aligned first and second contacts of each switch said third sheet having a plurality of holes therethrough each of which is aligned with a respective plunger, said third sheet having a thickness at least at said holes to separate respective first and second contacts of respective switches in an open state of a respective switch, said plungers being mounted to be axially displaceable towards respective first and second contacts by force applied to said first sheet in a respective active location and to be axially displaceable away from respective first and second contacts when such force is released, whereby axial displacement of a respective plunger towards respective first and second contacts pushes a respective first contact into electrical contact with a respective second contact through a respective hole to define a closed state of a respective switch.

36. The electronic game of claim 35 wherein the third sheet is of generally uniform thickness made of an elastically deformable material such that it is compressed at a respective hole during displacement of a respective plunger towards respective first and second switch contacts to facilitate electrical contact of respective first and second switch contacts and which relaxes at said holes during displacement of a respective plunger away from respective first and second switch contacts to facilitate separation of respective first and second switch contacts.

37. The electronic game of claim 36 wherein said interactive section comprises a fourth flexible sheet positioned between said first sheet and said third sheet, and a fifth flexible sheet positioned between said third flexible sheet and said second flexible sheet, said first and second conductors comprising conductive traces carried by said fourth and fifth flexible sheets, respectively.

38. The electronic game of claim 37 wherein said first and second contacts comprise portions of respective traces which are aligned with respective holes in staid third sheet and respective plungers.

39. The electronic game of claim 38 wherein said indicator devices comprise lamps and said conductors coupling said lamps to said electronics section comprise insulated wires.

40. The electronic game of claim 36 wherein said interactive section comprises another sheet made of elastically deformable material positioned between said second switch contacts and said second sheet.

41. An interactive electronic game comprising an interactive section and an electronics section, said game providing prompts to a player and receiving and scoring the player's responses;

said interactive section including a plurality of discrete indicator devices which each provide visually perceptible prompts, a plurality of discrete electrical switches, and a plurality of spaced active locations which each include an indicator device and a switch, said indicator devices and said switches being coupled to said electronics section by flexible conductors, said interactive section comprising a section of flexible tubing physically connecting two active locations, said flexible conductors extending between active locations and said electronics section in said sections of tubing and coupling respective switches, indicators and said electronics section, said interactive section having a playing configuration with a largest side having a first area and a non-playing configuration with a largest side having a second area which is at least one third of the first area, said sections of flexible tubing between said active locations permitting said interactive sections to be reconfigured from said playing configuration to said non-playing configuration and from said non-playing configuration to said playing configuration.

* * * * *